United States Patent [19]

Merjan

[11] Patent Number: 4,462,716

[45] Date of Patent: Jul. 31, 1984

[54] PILE DRIVING

[76] Inventor: Stanley Merjan, 16 Beacon Dr., Port Washington, N.Y. 11050

[21] Appl. No.: 349,010

[22] Filed: Feb. 16, 1982

[51] Int. Cl.[3] ..... E02D 5/34; E02D 7/14

[52] U.S. Cl. ..... 405/233; 405/232; 405/253

[58] Field of Search ..... 405/232, 233, 242, 245, 405/253, 255

[56] References Cited

U.S. PATENT DOCUMENTS

| | | | |
|---|---|---|---|
| 2,080,493 | 5/1937 | Marsden | 405/245 |
| 2,465,557 | 3/1949 | Thornley | 405/233 |
| 3,316,722 | 5/1967 | Gibbons et al. | 405/245 |
| 3,443,387 | 5/1969 | Johnson | 405/245 |
| 3,693,364 | 9/1972 | Bodine | 405/245 |
| 3,913,337 | 10/1975 | Merjan . | |

OTHER PUBLICATIONS

Chellis "Pile Foundations," (1951) pp. 233–236 (and title page).

*Primary Examiner*—Cornelius J. Husar
*Assistant Examiner*—Nancy J. Stodola
*Attorney, Agent, or Firm*—Abner Sheffer

[57] ABSTRACT

Shell piles having driving tips are driven with a pipe mandrel having a shoulder for engaging the top of the shell.

5 Claims, 9 Drawing Figures

PILE DRIVING

This invention relates to the driving of shell piles. Such piles are commonly installed by driving a thin-walled metal tube into the ground and filling the tube with concrete. The tube or shell is typically made of steel having a wall thickness of about 1/32 inch to 1/16 inch (such as 14, 16 or 18 U.S. Standard gage) which is helically corrugated. Typically the valleys of the corrugations are about ½ inch deep and the corrugations are about 2 inches wide (measured from one peak to the next) with a helical pitch of about ¾ turn per foot of axial length. The tube (shell) is thus susceptible to expansion and contraction both radially and axially.

Generally such piles are driven by hammer blows applied to the top expansible mandrel which fits within the shell and has expansion elements for firmly engaging the inner walls of the corrugated shell along its length. Many patents have been for such mandrels. The expansible mandrels in commercial use in the United States have included the Hercules mechanically expansible mandrel, the Cobi and Candler-Rusche pneumatic mandrels, the Guild mandrel (which uses an arrangement of cables, sheaves and pulleys that may be hydraulically actuated to expand the mandrel) and the mandrel shown in Merjan U.S. Pat. No. 3,984,992.

The hammer blows are typically applied by means of high energy pile driving hammers such as those having energies of about 15,000 to 50,000 foot pounds per blow or more.

In some situations one may use a mandrel which does not engage the inner walls of the shell but which transmits the force of the hammer blows directly to a pile tip at the base of the shell. The resultant downward movement of the tip is transmitted to the shell through the connection between the tip and the shell, and pulls the shell downward against the frictional resistance engendered by the contact between the soil and the outer walls of the shell. A procedure of this type, using a heavy pipe as the mandrel, is described in Merjan U.S. Pat. No. 3,913,337 at column 4 lines 22–29. The connection between the tip and the shell must of course be strong enough to cause the shell to move downward, with the tip, against the frictional resistance. When that resistance is high (as when the piles are relatively deep or the piles are driven through soil of high frictional characteristics, e.g. stiff clay, or dense sands) the operative connection between tip and shell may be broken, thus greatly reducing, or destroying, the effectiveness of the pile.

The problem of disconnection of sleeve and tip may be solved in the manner described in Merjan U.S. Pat. No. 3,913,337 (at column 11 line 8 to column 12 line 11) which describes the use of a protective sleeve to shield the outer walls of the shell from contact with the soil. The present invention provides a much simpler and cheaper way to solve the problem.

In the accompanying drawings,

FIG. 1 is a view, partly in cross-section, showing the bottom of a pile stem fitted into the socket of a pile tip, the pile being of the type described in Merjan U.S. Pat. No. 3,913,337.

Figure 1:
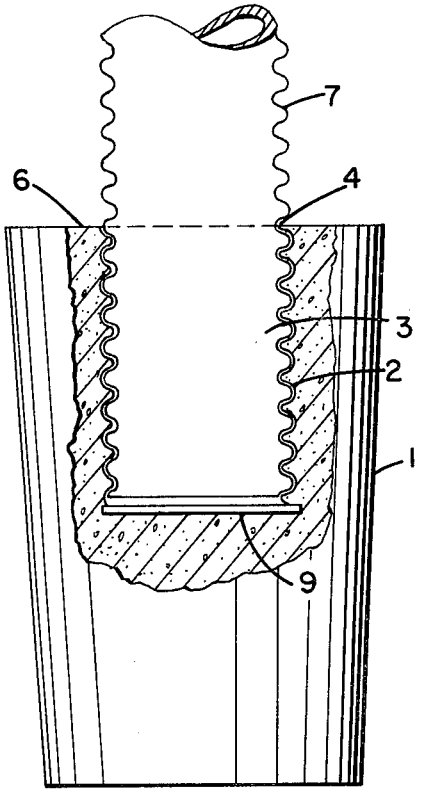
FIG. 1 PRIOR ART
Figure 4:
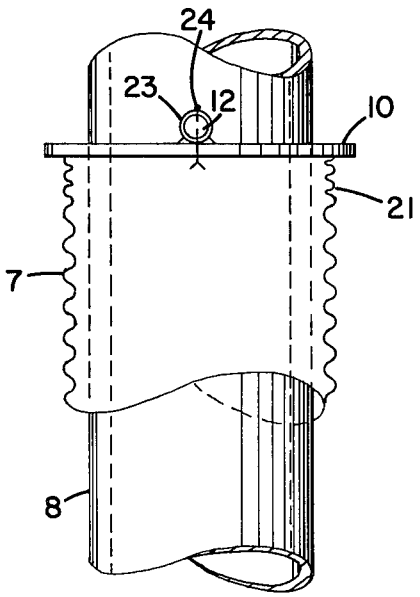
FIG. 4 is a side view at about the top of the pile stem showing the parts after the hammering.

Turning now to FIG. 1, reference numeral 1 shows a reinforced concrete pile tip of the type shown in FIGS. 1 and 4 of Merjan U.S. Pat. No. 3,913,337. As illustrated here the tip is formed by casting concrete in place around a relatively short length or stub of threaded (corrugated) shell 2 leaving a substantially cylindrical central open socket 3 in the upper part of the tip, the top 4 of the stub 2 being substantially flush with the substantially flat top surface 6 of the concrete tip. The internal diameter of the stub 2 is slightly larger (e.g. ⅛ to ¼ inch larger) than the external diameter of the correspondingly threaded (corrugated) shell which serves as the stem 7, so that the stem can be screwed into the socket easily. Typically the depth of the socket is about half the height of the tip.

Figure 2:
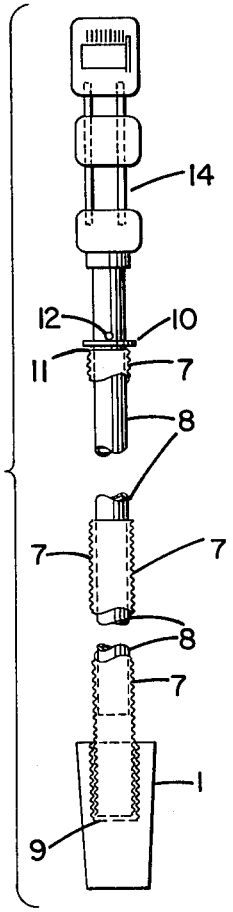
FIG. 2 is a schematic view, in elevation, with parts broken away, showing the assemblage of pile tip, pile stem, mandrel and hammer.

The mandrel 8 (FIG. 2) is a thick-walled steel pipe which is placed into the stem so as to make operative driving contact with the tip 1. (Preferably it rests on a steel plate or boot which forms the base 9 of the socket; that plate preferably has a larger diameter than that of the stub and is put in place before the concrete of the tip is cast).

Figure 3:
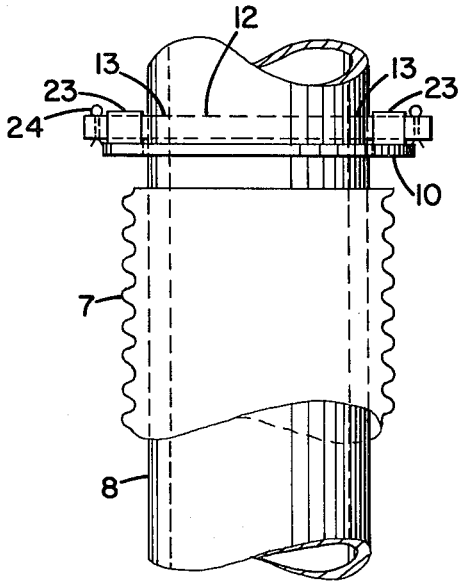
FIG. 3 is a front view at about the top of the pile stem showing the parts before hammering begins.
Figure 5:
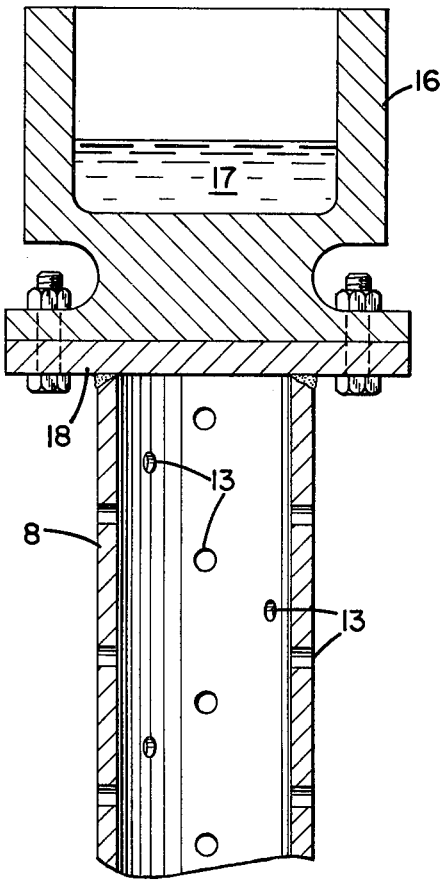
FIG. 5 is a cross-sectional view of the upper part of the mandrel with an anvil attached.

At the upper portion of the mandrel 8 there is a shoulder, such as circumferential flange 10 situated at a level to rest on (or, more usually, to be slightly above) the top 11 of the stem 7. In one suitable form the flange 10 is adjustably attached to the mandrel by a bolt or pin 12 which passes through holes 13 (FIGS. 3–5) in the mandrel, there being a series of such holes (see FIG. 5) situated at spaced intervals (e.g. at levels 6 inches apart) in the upper portion of mandrel 8. This makes it possible to place the flange within a corresponding distance (e.g. within 6 inches) from the top of the stem, for a variety of stem lengths.

Typically the tip, with the stem screwed into its socket, is positioned at the spot where the pile is to be driven, the mandrel is hoisted into the vertical stem so that it rests on the base of the socket, and the conventional power hammer 14 (FIG. 2) is placed over the top of the mandrel. The mandrel usually has secured thereto an anvil 16 carrying a cushion 17 (as shown, for instance, in FIG. 5 in which the top of the mandrel has welded thereto a plate 18 to which the anvil 16 is bolted).

I have found that when driving a shell pile having such an enlarged tip, using a non-expanding pipe mandrel, the connection between the shell and the tip appears to be stable for the very first part of the driving operation. But as driving continues the shell may begin to lag behind the tip (as can be seen from the relative positions of stem and mandrel). For instance, the stem may rotate relatively so that in effect its lower end is gradually becoming unscrewed from the socket; or the lower end of the stem may begin to snap out, corrugation by corrugation, from the socket; or a similar snapping out effect may occur as a result of a tension wave or rebound wave which passes upward through the shell after the downward wave of compression (resulting from a driving hammer blow) has arrived at the bottom of the mandrel and been transmitted to the tip.

The pressure of the flange 10 has been found to maintain the operative connection between stem and tip throughout the driving operation without any adverse effects on the stem even when the stem is quite long (e.g. 30 feet or more) despite the absence of any supportive and stiffening interaction between the thin shell stem and mandrel (such as is provided by the expanding type of mandrel).

Figure 6:
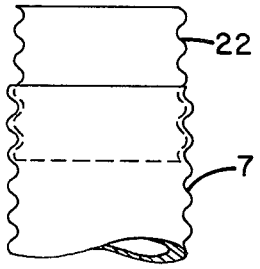
FIG. 6 is a view of an alternative arrangement in which the top of the stem is fitted with a collar.
Figure 7:
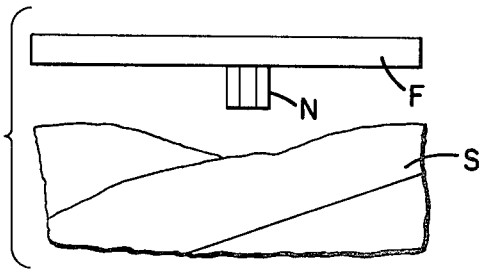
FIG. 7 is a side view of an embodiment in which the shoulder on the mandrel is a flange F having diametrically opposed projecting bolt ends carrying nuts N (said bolts and nuts serving to help source the flange to the mandrel); this Fig. also shows the crimping effect at the top of the shell stems resulting from forcible contact between the top of the stem and the projecting nut.

As indicated above, the flange 10 need not be precisely pre-positioned at the top of the stem. If it is prepositioned higher, it will move downward and engage that top of the stem when, as described above, the stem begins to lag behind the tip during the driving of the pile. The force urging the flange toward the top of the stem usually causes the top of the stem to become crimped (e.g. for an inch or two measured axially) or otherwise distorted by the flange, as shown at 21 in FIG. 4. The top of the stem may be fitted with a collar (e.g. 22 in FIG. 6) made of a short length of corrugated shell material screwed into, or onto, the top of the stem, to receive (and be crimped by) the action of the flange.

The mandrel shoulder which engages the top of the shell may be variously constructed. For instance, it may be a circular flange or it may comprise a set of radial projections, preferably of such size and spacing around the circumference of the pipe mandrel as to avoid undue local distortions of the top of shell. Various means may be employed for maintaining the flange in position on the mandrel.

In the illustrated embodiment, the flange 10 has a pair of upstanding diametrically opposed ears 23 having holes through which pin 12 passes; cotter pins 24 act to keep that pin 12 in place.

It will be understood that, particularly for long piles, the shell may be made up of a plurality of lengths connected together by conventional threaded adapters (such as the one shown in FIG. 4 of U.S. Pat. No. 3,913,337) and the pipe mandrel may similarly be made up of a plurality of lengths of pipe connected together, at their ends.

The effectiveness of the mandrel of this invention has been demonstrated on two jobs. One such job involved the driving of a number of 60 ton-capacity piles having enlarged precast concrete bases and cylindrical corrugated shells into a soil whose profile consisted of the following (listed from the top down): 10 to 15 feet of fill materials (bricks, rubble, broken concrete, and wood mixed with clayey soils), 3 to 10 feet of generally granular soil having an "N" (Standard Penetration) value of between 5 and 30, 5 to 15 feet of medium to stiff silt and/or clay, and then a mixture of sand and gravel having an "N" value of between 15 and 30. The overall driven lengths of these piles varied between 25 and 45 feet. The dimensions of the precast concrete base were 24 inch top diameter, 20 inch bottom diameter, 36 inch height. The socket of that base was an 18 inch length of 18 gage steel corrugated shell having a nominal diameter of $10\frac{1}{4}$ inches, to the lower end of which there had been welded a steel plate 11 inches in diameter and 3/16 inch thick. The concrete of that base had been cast around that steel socket so that the top of the socket was flush with the top of the base. The pile stem was a 16 gage thick shell having a 10 inch nominal diameter and was threaded into the socket for its full 18 inch depth. At the outset of this work, an expandable mandrel of the type described in U.S. Pat. No. 3,984,992 was used to drive these piles. The mandrel was 52 feet long, extending through the pile stem and into the shell in the base, bearing on the lower steel plate therein. A steam powered Vulcan Model "O" hammer striking an anvil bolted to the top of the mandrel drove the pile. However, the presence of obstructions in the upper fill produced in many instances, considerable resistance, requiring 60 or more blows per foot of pile penetration. Also the obstructions laterally deflected the pile base, making it necessary for the pile driving rig to apply a corrective lateral force to the mandrel in the attempt to straighten the pile. The combination of hard driving and the forcing of the pile into a plumb position caused failures due to bending of the expandable mandrels. A 50 foot long mandrel consisting of $9\frac{5}{8}$ inch diameter by 1 inch thick circular steel pipe was then substituted for the expandable mandrel and this mandrel demonstrated ample strength and stiffness to overcome the driving difficulties. However, it was observed that after the shells would penetrate into the soil 15 feet or deeper, they would being to rotate out of the base and slip upwards up on the mandrel, indicating that the shells were stretching or "popping" out of the mating corrugations in the pile base.

A steel flange was then bolted through the mandrel several inches above the top of the shell stem. While driving the piles with this flange in place the shell stems were observed to rotate and climb the mandrel as with the earlier driving, but when the tops of the shells made contact with the underside of the flange the rotation and upward creep stopped. In some instances the shells were crimped at the top by the action of the flange; they then exhibited no further movement relative to the mandrel. This crimping presented no problems because it occurred above the final cut-off elevation of the pile. In this job, some 200 piles were successfully completed using this mandrel and flange with no failures.

Another job involved piles of 70 ton-capacity driven to a depth of 45 to 55 feet, into soil whose profile consisted of 5 to 15 feet of dense clay and silt fill overlying 30 to 40 feet of soft clay. The bearing stratum into which the piles were driven was medium to dense sand and gravel ("N" varies between 15 and 50) located below the soft clay. The piles were like those described for the first job, except that the overall pile length ranged to a maximum of 55 feet. The mandrel length was 55 feet and the flange was adjustably positioned at various levels of the mandrel by bolting it at pairs of holes provided at various levels on the mandrel to accommodate the different shell lengths in use.

The present invention makes it possible to drive piles having cylindrical shell stems as long as 60 and perhaps 100 feet or more. Shell gages may be selected to meet the requirement of particular conditions of this driving with respect to the amount of friction generated by soil coming into contact with the stem during the driving and the tension wave in the shell produced by the blows of the hammer. For most jobs 16 gage shell will suffice; for others where such friction and/or tension wave conditions are more severe, 14 gage and even 12 gage shell may be needed.

The outside diameter of the mandrel is preferably almost as large as the inside diameter of the shell, preferably within about an inch; for instance for driving a pile whose shell stem has an internal diameter of 10¼ inches a mandrel whose outer diameter is about 9½ inches works very well. The usual mathematical analyses, such as wave equation analysis, may be used to evaluate and predetermine each particular combination of the various factors, such as hammer energy, pile capacity, mandrel diameter and length and width of the shell. Various sizes of the enlarged tapered bases may be used; such as a small size (e.g. height: 30 inches; diameter at bottom: 13 inches; diameter at top: 17 inches) or a very large size (e.g. height: 10 feet; diameter at bottom: 5 feet; diameter at top: 6 feet).

The invention affords considerable flexibility in pile selection because of the simplicity and economy of the mandrel. For example, for lightly loaded structures requiring 20 to 30 ton capacity piles, the invention makes it possible to drive an 8 inch diameter corrugated shell with an enlarged base by means of a 7 inch diameter pipe mandrel; this will in many cases be more economical than the driving of the treated timber piles which are usually used for this purpose. At the other end of the spectrum, the invention makes it possible to drive, economically, piles having very high capacity (say up to 500 tons) which require larger diameter shells (24" or more), by the use of larger pile hammers (whose energies are 1,000,000 ft. lbs. or more per blow) acting on very strong stiff pipe mandrels. To data capacities exceeding 200 to 250 tons are rarely exceeded because of the limitations of existing piling types and the interrelationship with soil conditions. The composite piles having enlarged bases offer the means of producing extraordinary high loadings on certain soils and the present invention makes it possible to use relatively economical and readily available large diameter pipe to drive the economical large diameter shell (later filled with high-strength concrete) needed to transfer loads from the structure to the base.

After the pile has been driven the mandrel is lifted out and the stem is filled with concrete which is then of course allowed to set to hardened condition. Before, or during, the filling with concrete appropriate reinforcing elements may be put in place in the stem, including reinforcing bars positioned to transmit uplift forces from the pile tip to the structure to be supported.

Figure 8:
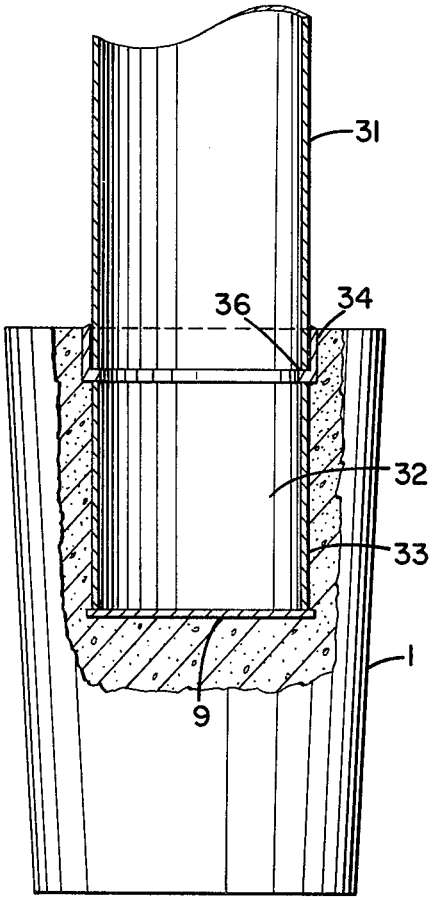
FIG. 8 is a view like FIG. 1 but showing another embodiment of the invention, in which the stem is a thin-walled non-corrugated pipe.

In another aspect of this invention the stem is a thin-walled pipe (e.g. a steel pipe 31 of such wall thickness as to be insufficient to withstand and transmit the pile driving blows directly, such as wall thickness of 3/16 to ⅜ inch depending on the driving conditions) instead of a corrugated shell and this stem is secured to the tip in a somewhat different manner. For instance, as illustrated in FIG. 8, the tip has a socket 32 formed from a short length or stub 33 of pipe, to the bottom of which the boot 9 is welded and to the top of which there is welded a pipe-receiving collar 34. The latter may be one half of a standard cast steel slip-fit sleeve having a lower shoulder 36 (on which the bottom of the pipe stem 31 bears) and having a tapered inner wall (to engage the lower part of the outer surface of that pipe stem 31). The tip is cast in place around the assemblage of welded-together stub 33, boot 9 and collar 34.

Figure 9:
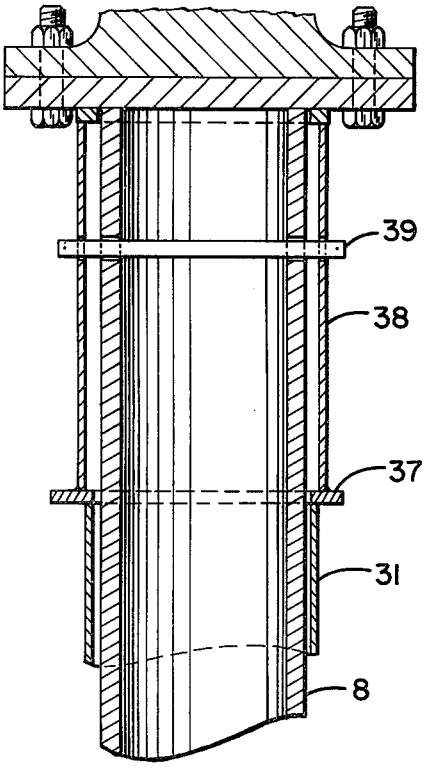
FIG. 9 is a view of the embodiment of FIG. 8, showing one construction of a shoulder to engage the top of the stem.

Before driving, with the tip in place in the ground, the pipe stem 31 is fitted into the collar 34 and welded thereto and the mandrel 8 is inserted into the pipe stem 31. The mandrel is provided with a flange whch fits snugly against the top of the pipe stem. In the embodiment illustrated in FIG. 9, the flange is an annular member 37 which is welded to the bottom of a short length of stub 38 of pipe of such diameter as to fit around the mandrel 8, the length of stub 38 being such that when it is positioned below the plate 18 (FIG. 5) of the mandrel its flange 37 presses against the top of the pipe stem 31 (this pressure may be such that the top of the pipe stem becomes crimped before and/or during driving). It is convenient for the stub 38 to be carried by the mandrel; thus it may be supported thereon by a pin 39 passing through holes in the stube and mandrel or by cables (not shown) etc.

It is to be understood that the foregoing detailed description is given merely by way of illustration and that variations may be made therein without departing from the spirit of the invention.

I claim:

1. Method of driving into the soil a pile having a hollow thin-walled continuous shell stem having a bottom and a top, said pile having an enlarged preformed lower tip having a socket into which the bottom of said shell stem is fitted, which comprises placing a mandrel having a bottom into said stem with the bottom of said mandrel being situated within said socket to transmit hammer blows through said mandrel directly to said tip, said mandrel having a shoulder positioned to overly the top of said shell stem and to limit upward movement of said stem relative to said mandrel during the driving of said pile, hammering on the top of said mandrel to drive said tip into the soil to a depth of at least about 20 feet, the outer surface of the thin wall of said stem being in contact with the soil and said stem being thereby frictionally retarded by said soil during said hammering, said shoulder acting to prevent separation of said tip from said stem during said hammering, withdrawing said mandrel from said stem and filling said stem with hardenable concrete.

2. Method as in claim 1 in which said mandrel is a pipe having a substantially uniform outside diameter throughout the length of said pipe within said stem, which diameter is less than the inside diameter of said stem.

3. Method as in claim 2 in which the top of said stem becomes deformed by contact with said shoulder during said hammering.

4. Method as in claim 3 in which said shoulder, said mandrel and said stem are substantially circular in cross-section and the top of said stem becomes crimped by contact with said shoulder during said hammering.

5. Method as in claim 4 in which said stem is a helically corrugated steel shell whose corrugations are about 2 inches wide (measured from one peak to the next) and about ½ inch deep with a helical pitch of about ¾ turn per foot, said stem having a diameter of about 8 inches to 24 inches.

* * * * *